US006405885B1

(12) United States Patent
Elliott

(10) Patent No.: US 6,405,885 B1
(45) Date of Patent: Jun. 18, 2002

(54) LOCKING TAMPER-EVIDENT DISPENSING CLOSURE

(75) Inventor: John Elliott, Burlington, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 11 days.

(21) Appl. No.: 09/747,865

(22) Filed: Dec. 22, 2000

(51) Int. Cl.[7] ..... B65D 47/08; B65D 47/10

(52) U.S. Cl. ..... 215/237; 215/253; 215/254; 222/541.5; 222/541.9; 222/556

(58) Field of Search ..... 215/235, 237, 215/250, 253, 254; 220/257, 266, 268, 270; 222/556, 541.5, 541.9

(56) References Cited

U.S. PATENT DOCUMENTS

| | | | |
|---|---|---|---|
| 1,333,334 | A | 3/1920 | Nesmith |
| 3,059,816 | A | 10/1962 | Goldstein |
| 3,255,928 | A | 6/1966 | Foster |
| 3,272,368 | A | 9/1966 | Baarn |
| 3,341,046 | A | 9/1967 | Bereziat et al. |
| 3,441,161 | A | 4/1969 | Baarn |
| 3,480,184 | A | 11/1969 | Landis |
| 3,850,329 | A | 11/1974 | Robinson |
| 3,860,148 | A | 1/1975 | Sherin |
| 3,976,215 | A | 8/1976 | Smalley |
| 3,986,627 | A | 10/1976 | Zapp |
| 3,990,598 | A | 11/1976 | Zapp et al. |
| 4,024,976 | A | 5/1977 | Acton |
| 4,062,466 | A | 12/1977 | Conti |
| 4,081,108 | A | 3/1978 | Wilson et al. |
| 4,129,226 | A | 12/1978 | Percival |
| 4,153,174 | A | 5/1979 | Keeler |
| 4,170,315 | A | 10/1979 | Dubach et al. |
| 4,193,519 | A | 3/1980 | Dubach et al. |
| 4,196,818 | A | 4/1980 | Brownbill |
| 4,244,495 | A | 1/1981 | Lorscheid et al. |
| 4,262,814 | A | 4/1981 | Roccaforte |
| 4,299,328 | A | 11/1981 | Ochs |

(List continued on next page.)

FOREIGN PATENT DOCUMENTS

| | | |
|---|---|---|
| AU | 71/35561 | 11/1971 |
| DE | 2155664 | 6/1972 |
| EP | 0 251 123 | 7/1988 |

OTHER PUBLICATIONS

U.S. Patent application No. 09/748,630, filed Dec. 22, 2000.

*Primary Examiner*—Nathan J. Newhouse
(74) *Attorney, Agent, or Firm*—Wood, Phillips, Katz, Clark & Mortimer

(57) ABSTRACT

A closure structure for a container includes a closure body having a deck and a depending skirt, the skirt being adapted to be mounted on a container neck or formed with the container. A dispensing orifice is formed through the deck. A protruding member extends from a surface of the deck, the protruding member including a first locking ledge at an intermediate position along a length of the protruding member. A lid, hinged at one side to the closure body at a position opposite to the protruding member, has a socket on a side of the lid opposite the hinge. The socket has a receiver cavity open in an axial direction of the lid and includes a second locking ledge extending radially within the receiver cavity. The first and second locking ledges are engageable when the protruding member is positioned sufficiently within the receiver cavity when the lid is initially closed to the body. The engagement of the first and second locking ledges prevents the lid from being opened from the body, the socket and the protruding member being connected to the lid and the body respectively by frangible elements. The body includes an inset on a surface thereof below the protruding member, and the lid includes an apron extending from the socket. The apron and the inset being shaped and configured such that the apron fits within the inset to be flush with adjoining surfaces of the annular skirt of the body when the lid is engaged to the body.

26 Claims, 8 Drawing Sheets

U.S. PATENT DOCUMENTS 4,345,692 A 8/1982 Obrist et al.
4,353,483 A 10/1982 Pehr
4,371,088 A 2/1983 Gach
4,418,828 A 12/1983 Wilde et al.
4,420,089 A 12/1983 Walker et al.
RE31,496 E 1/1984 Keeler
4,449,631 A 5/1984 Levenberg et al.
4,467,931 A 8/1984 Gach
4,487,324 A 12/1984 Ostrowsky
4,629,081 A 12/1986 McLaren
4,696,408 A 9/1987 Dubach
4,709,823 A 12/1987 Beck et al.
4,711,372 A * 12/1987 Gach ..... 215/237
4,718,567 A 1/1988 Vange
4,782,964 A 11/1988 Poore
4,787,530 A 11/1988 Edward
4,795,044 A 1/1989 Beck
4,919,286 A 4/1990 Aghay, Sr.
4,941,592 A * 7/1990 Kitterman ..... 215/253
4,974,735 A 12/1990 Newell
4,986,430 A 1/1991 Dutt
5,058,775 A 10/1991 Gross et al.
5,115,934 A 5/1992 Nelson
5,123,561 A 6/1992 Gross
5,137,260 A 8/1992 Pehr
5,141,138 A 8/1992 Odet et al.
5,147,054 A 9/1992 Pehr
5,201,440 A 4/1993 Gross
5,356,017 A 10/1994 Rohr et al.
5,356,018 A 10/1994 Dubach
5,386,918 A 2/1995 Neveras
5,392,938 A 2/1995 Dubach
5,427,260 A 6/1995 Mueller et al.
5,462,183 A * 10/1995 Rohr et al. ..... 215/237
5,464,112 A * 11/1995 Guillot ..... 215/254
5,465,876 A 11/1995 Crisci
5,605,240 A 2/1997 Guglielmini
5,685,444 A * 11/1997 Valley ..... 215/237
5,735,419 A 4/1998 Ma
5,775,528 A 7/1998 Wohlgemuth
5,785,209 A 7/1998 Guglielmini
5,829,610 A * 11/1998 Rohr et al. ..... 215/237
5,853,093 A 12/1998 Neiger
5,860,545 A 1/1999 Bartsch
5,875,906 A 3/1999 Price et al.
5,875,907 A 3/1999 Lay
5,875,942 A 3/1999 Ohmi et al.
5,931,291 A * 8/1999 Sedon et al. ..... 220/266
5,938,054 A 8/1999 Loader
5,984,125 A 11/1999 Price et al.
5,992,659 A 11/1999 Nofer et al.
6,003,712 A 12/1999 Mogard et al.
6,116,441 A * 9/2000 Decelles et al. ..... 215/237

* cited by examiner

LOCKING TAMPER-EVIDENT DISPENSING CLOSURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to dispensing closures. Particularly, the invention relates to a dispensing closure having a closure body with a dispensing opening, a closure lid that is engageable to the closure body to close the dispensing opening, and a tamper-evident feature which fixes the closure lid in an engaged, closed position on the closure body. The tamper-evident feature is torn or broken when the closure lid is initially opened by a user.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence—even after the lid or spout has been subsequently closed.

Some types of tamper-evident systems require an overt action by the user such as removing an added component such as a removable "neck band" or other added component. Other tamper-evident systems require removing or breaking an integral element such as a "tear away" feature to permit removal of the closure or to otherwise open the container. Some examples of such systems are represented by U.S. Pat. Nos. 4,487,324; 5,058,775; 5,201,440; 5,427,260; and 5,875,907.

Other types of tamper-evident systems are more automatic in their function. As the user opens the package, such as by removing the closure from the container, an integral component of the closure is irreparably broken in such a way that it is evident the original seal has been breached. Some examples of such systems are represented by U.S. Pat. Nos. 4,196,818; 4,153,174; and 5,875,906.

While the above-mentioned closures can function well for the purposes for which they have been designed, the present inventor has recognized that it would be desirable to provide an improved tamper-evident closure which could be readily fabricated to associate with certain types of lids or flow control elements and which, prior to initial opening, could enhance the cosmetic appearance of the closure. The present inventor has recognized that it would be desirable if such a tamper-evident closure could be easily installed on a container to its tamper-indicating ready condition for eventual delivery to the consumer or other user. The present inventor has recognized that it would be desirable to provide a tamper-evident closure that was easy and self-explanatory to use by consumers while still providing an attractive appearance, ease of application by packagers, and simplicity in molding by the closure producer.

BRIEF SUMMARY OF THE INVENTION

The present invention provides an improved closure structure which is effectively manufactured, assembled, handled, and opened by a consumer or other user. The closure structure provides a self-explanatory and effective tamper evident system as well as a pleasing cosmetic appearance.

The closure structure of the present invention includes a closure lid hinged to a closure body and a tamper-evident feature which locks the closure lid to the closure body. The tamper-evident feature comprises a two piece assembly: a body frangible part, connected by a breakable connection to the closure body, and a lid frangible part, connected by a breakable connection to the closure lid. Preferably, the body frangible part comprises a protruding member, and the lid frangible part comprises a socket. The body frangible part is snap-connected to the lid frangible part so that the protruding member fits into the socket upon initial closing of the lid to the body by the manufacturer, assembler or filler. To open the closure structure, a consumer first removes both the frangible parts together from the body and lid, and then the lid can be lifted to an open position.

According to an exemplary embodiment of the invention, the body includes a deck surrounded by a recessed annular shoulder, and a downwardly depending skirt or annular sidewall. The protruding member comprises a tongue protruding axially from the shoulder and having a radially extending first locking ledge. The tongue is connected to the shoulder by breakable webs. The tongue includes a shoulder portion or base which prohibits the tongue from being separated from the lid frangible part after the frangible parts are removed together from the body and lid. This feature minimizes separate scrap pieces as litter from carelessly discarded frangible parts.

The lid frangible part includes a tab portion which partly defines a socket having a vertically or axially oriented receiver cavity. An apron extends downwardly from the tab portion. The socket includes a second locking ledge protruding radially into the cavity.

When the lid is closed to the body, the tongue is received into the receiver cavity of the socket, and the locking ledges mutually engage to lock the tongue within the cavity. The lid frangible part and the body frangible part, once engaged, cannot be separated without the creation of readily perceptible tamper evidence. The body includes a front sidewall inset which is sized and shaped to receive the apron when the lid is closed to the body, such that an outside surface of the apron is flush with the adjacent surfaces of the body sidewall.

The apron serves at least four functions: 1) it fills the body inset to maintain cosmetic continuity, 2) it guides the integral body tongue into the receiver cavity during the closing operation, 3) it provides a lever arm (fulcrum) about which the frangible tamper-evident assembly of lid frangible part and body frangible part rotates during removal, and 4) it provides stability and support to the tamper-evident assembly making it less susceptible to breakage due to unintentional outside forces.

The closure lid preferably has a partially circular perimeter but with a front recess which accommodates the tab portion such that the tab portion does not extend outwardly of a full circle defined in part by the partially circular perimeter. The tab portion covers the front recess until removed. The lid includes a lifting lip extending radially into the front recess. Once the tab portion is removed with the frangible parts as a unit, the lifting lip and the front recess are exposed. A user can lift the lid by exerting an upward prying force on the lifting lip.

The present invention provides readily apparent indication of tampering with a closure structure. The invention provides a tamper-evident feature which has an integrated appearance with the remaining portions of the closure structure. The function and operation of the tamper-evident feature are readily understandable to the consumer, even upon casual inspection.

The entire closure structure, including the tamper-evident feature, can be injection molded with a simple straight pull on both sides of the mold, requiring no side actions, lifters, cams or other ancillary components which otherwise would be required for undercut molding techniques. The closure structure of the present invention allows for the molding of the closure structure using simplified tooling. The simplified mold tooling allows maximized number of mold cavities per given mold tool size. The simplified mold tooling significantly reduces mold maintenance over the life of the mold. The simplified mold tooling significantly contributes to mold robustness. That is, the mold is less sensitive to variations in molding and environment. The simplified mold tooling significantly reduces inventory of spare parts or replacement components for the mold.

Additionally, during initial assembly of the closure structure of the present invention, no secondary operation is required to set the tamper-evident feature. The tamper-evident feature is set automatically during the initial lid closing operation by the molder after the closure structure is released from the mold.

The closure structure of the present invention provides significant reduction in capping operation problems due to having a totally inboard configuration, that is, the closure structure having no projections extending beyond an overall outside diameter of the closure structure. This feature eliminates a source of considerable damage and downtime.

Numerous other advantages and features of the present invention will become readily apparent from the following detailed description of the invention and the embodiments thereof, from the claims and from the accompanying drawings.

BRIEF DESCRIPTION OF THE DRAWINGS

The accompanying drawings form part of the specification, and like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se described herein forms no part of some embodiments of the invention and therefore is not intended to limit the present invention. It will also be understood by those of ordinary skill that novel and non-obvious inventive aspects are embodied in the described exemplary closure structures alone.

Figure 1:
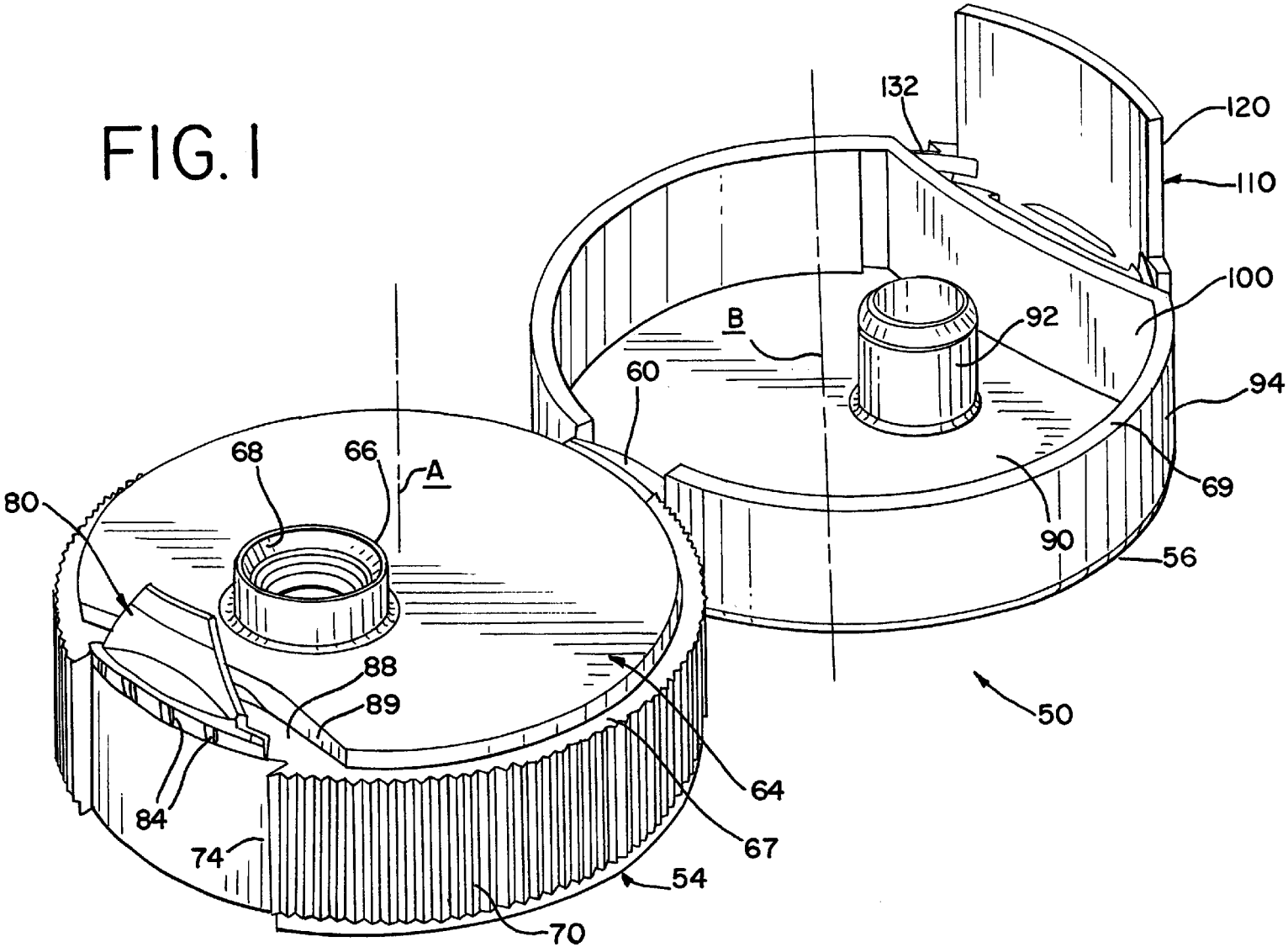
FIG. 1 is a perspective view of a closure structure of the present invention as embodied in a closure that includes a closure body and a closure lid which are shown in an as-molded condition before being initially closed.

FIG. 1 illustrates a closure structure 50 in an as-molded initially open condition. The closure structure 50 comprises a closure body 54 and a closure lid 56. The closure lid 56 is preferably hinged to the closure body 54 by a molded hinge 60 (shown in FIG. 6). The closure body 54 includes a deck 64 which carries, or is formed with, a dispensing spout or nozzle 66. The dispensing nozzle 66 defines a dispensing orifice 68. With respect to a central axis A of the body 54, the dispensing nozzle 66 can be either concentrically located, or eccentrically located as shown in FIG. 1.

A recessed, substantially annular shoulder 67 surrounds the deck 64. The annular shoulder 67 is arranged to receive a bottom annular surface 69 of the closure lid 56 when the closure lid 56 is fully closed to the body 54.

Depending from the deck 64, below the shoulder 67, is an annular sidewall or skirt 70 having a knurled or ribbed surface around a substantial portion of its circumference and having a front sidewall recess or inset 74 on a side of the body 54 opposite the hinge 60.

Figure 10:
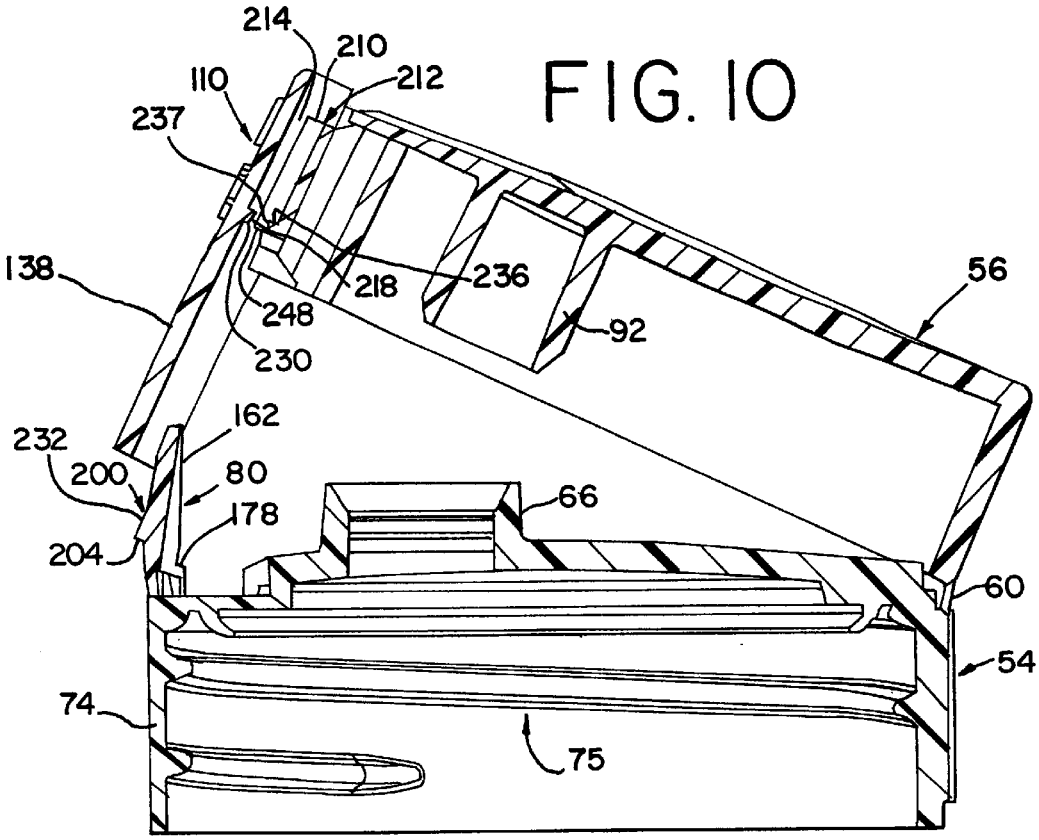
FIG. 10 is a sectional view of the closure structure shown in FIGS. 1 and 2, as the closure lid is being closed initially to the closure body.

The interior of the skirt 70 defines an internal, female thread formation 75 (shown in FIG. 10). The skirt 70 is adapted to receive and threadingly engage a thread on the upper end of a container neck or mouth (not illustrated). Alternatively, the closure skirt 70 could be provided with some other container connecting means, such as a snap-fit bead or groove (not illustrated) in place of the thread formation for engaging a container groove or bead (not illustrated), respectively, in the container neck. The closure body 54 could also be permanently attached to the container by means of induction melting, ultrasonic melting, gluing, or the like, depending on materials used for the closure body 54 and in the container. The closure body 54 could also be formed as a unitary part, or extension, of the container.

Particularly when the closure body is removable by unscrewing from the container, a second tamper-evident feature, such as a frangible band, (not shown) can be formed around a bottom edge of the skirt.

The closure body skirt 70 may have any suitable configuration. The container could have an upwardly projecting neck or other portion for being received within the particular configuration of the closure body skirt 70, and the main part of the container may have a different cross-sectional shape than the container neck and closure body skirt 70.

The closure structure 50 is adapted to be used with a container having a mouth or other opening to provide access to the container interior and to a product contained therein. The product may be, for example, a comestible product. However, the closure structure 50 could also be used with many other materials, including, but not limited to, relatively low or high viscosity liquids, particulates, etc. as constituting a food product, a personal care product, an industrial or household cleaning product, or other chemical compositions (e.g., compositions for use in activities involving manufacturing, commercial or household maintenance, construction, agriculture, etc.).

The container with which the closure system may be used would typically be a squeezable container having a flexible wall or walls which can be grasped by the user and squeezed or compressed to increase the internal pressure within the container so as to force the product out of the container and through the closure structure 50. The container wall typically has sufficient, inherent resiliency so that when the squeezing forces are removed, the container wall returns to its normal, unstressed shape. Such a squeezable wall container is preferred in many applications but may not be necessary or preferred in other applications. For example, in some applications it may be desirable to employ a generally rigid container and pressurize the container interior at selected times with a piston or other pressurizing system.

A tamper-evident body frangible part 80 is connected to the body shoulder 67 by frangible webs 84, at a position adjacent the inset 74. The body frangible part 80 extends upwardly from a wide, front region 88 of the shoulder 67. The front region 88 is in part defined by a curved front edge 89 of the deck 64.

The closure lid 56 includes a top wall or end wall 90 (shown in an inverted orientation while the closure structure is open as shown in FIG. 1). Extending downwardly (upwardly in the inverted orientation of FIG. 1) from the top wall 90 is a substantially cylindrical spud 92 offset from a lid axis B. The spud 92 is arranged to fit within, and seal, the dispensing nozzle 66 when the lid 56 is closed on the body 54. A partially annular lid sidewall or skirt 94 extends downwardly (upwardly in the inverted orientation of FIG. 1) from the top wall 90 and is configured to surround the deck 64 of the closure body 54 when the lid 56 is closed to the body 54. The skirt 94 includes a slightly curved front wall 100, having a reverse concavity compared to the rest of the skirt 94, and which fits adjacent the front edge 89 of the deck 64 when the lid 56 is closed to the body 54.

Adjacent an outside of the front wall 100, externally of the skirt 94, is a lid frangible part 110. The lid frangible part 110 engages the body frangible part 80 when the lid 56 is fully closed onto the body 54.

Preferably, the closure structure 50 is molded in the fully open position shown in FIG. 1 which is advantageous in that the entire closure structure can be injection-molded as a single piece of thermoplastic material in a mold which does not require any side pulls for molding undercut parts.

Figure 2:
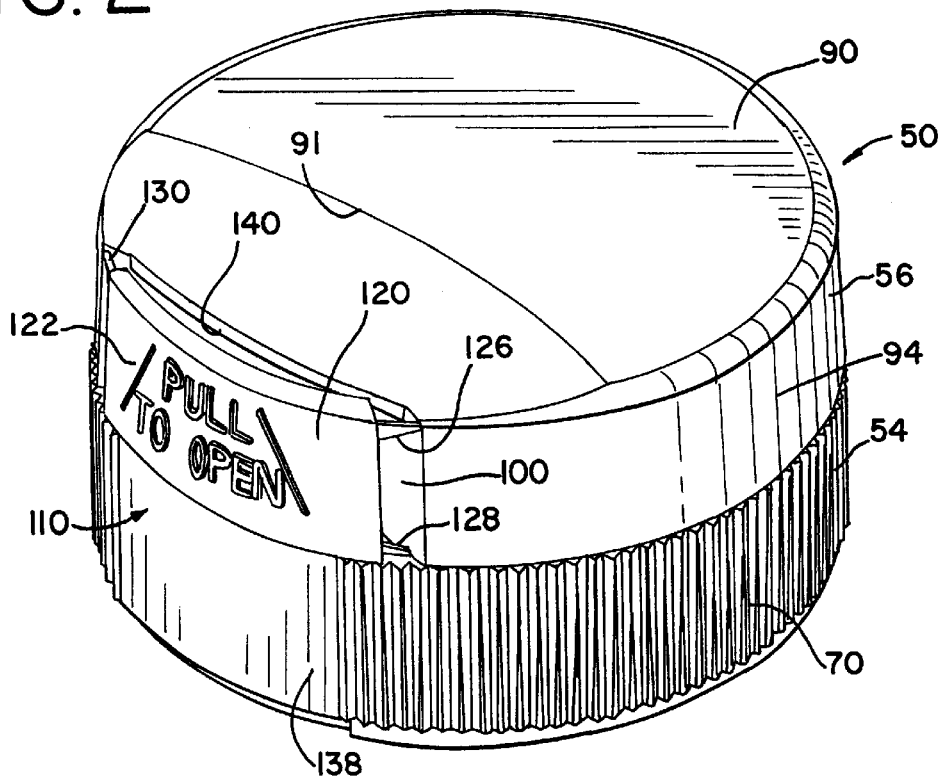
FIG. 2 is a perspective view of the closure structure shown in FIG. 1, but after the closure lid has pivoted closed onto the closure body.

FIG. 2 illustrates the closure structure 50 in the closed position wherein the lid 56 has been pivoted on the hinge to engage with the body 54. The lid frangible part 110 includes a partially annular tab portion 120 which can display opening instructions, such as in the form of molded indica 122. The tab portion 120 is connected by frangible webs 126, 128, 130, 132 (132 shown in FIGS. 1, 8, and 9) to the lid skirt 94, particularly to a front side of the front wall 100. The frangible webs are vertically staggered (as shown in FIG. 9), that is, the top frangible webs 126, 130 are positioned to the inside of the bottom frangible webs 128, 132 (or these relative positions can be reversed). This allows straight pull technology in the tooling for molding the closure structure, i.e., no undercuts or voids.

Figure 4:
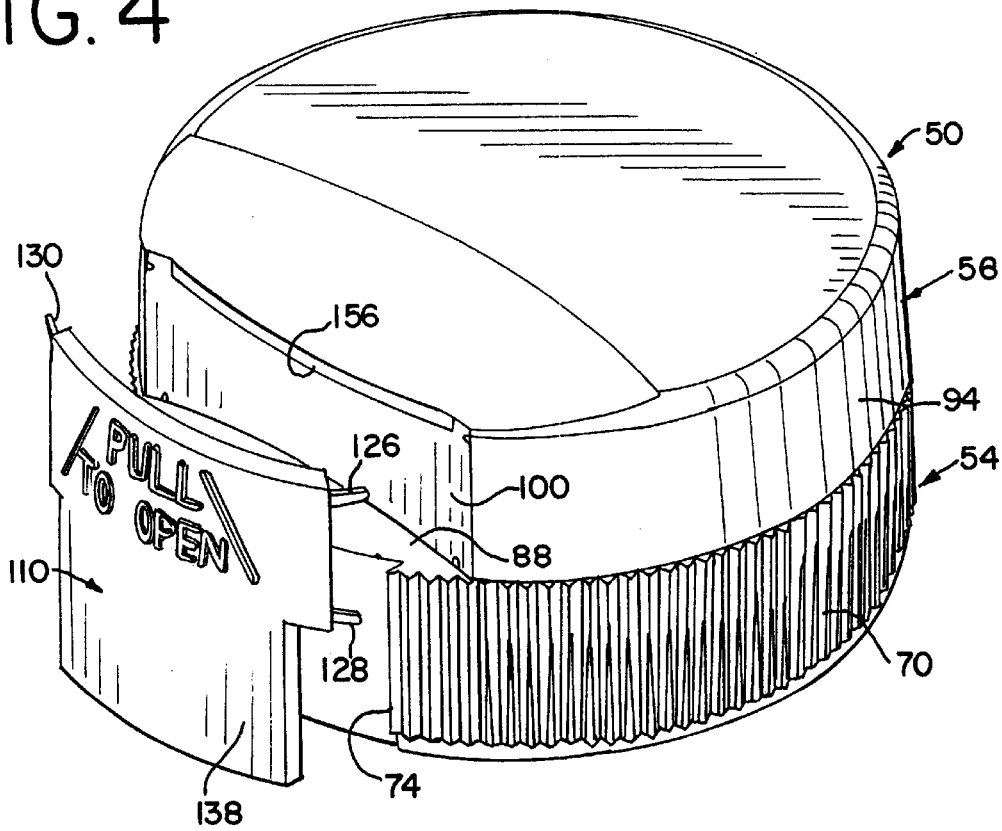
FIG. 4 is an exploded perspective view of the closure structure shown in FIG. 3 with a tamper-evident feature shown broken away at a second step of closure structure opening.

The lid frangible part 110 also includes an apron 138, depending from the tab portion 120. The apron 138 is shaped and sized to closely fit within the body inset 74 (FIG. 4). The apron 138 has a thickness substantially equal to a depth of the inset. This provides a substantially flush and continuous appearance of the sidewall 70 and apron 138.

The front wall 100 and the tab portion 120 define a crescent shaped opening 140 (FIG. 2) on a top side of the lid 56 which is useful to receive a portion of the user's finger into this opening 140 (see FIG. 3) to pry off the frangible parts 80, 110 from the lid 56 and the body 54, as will be described hereinafter.

Figure 3:
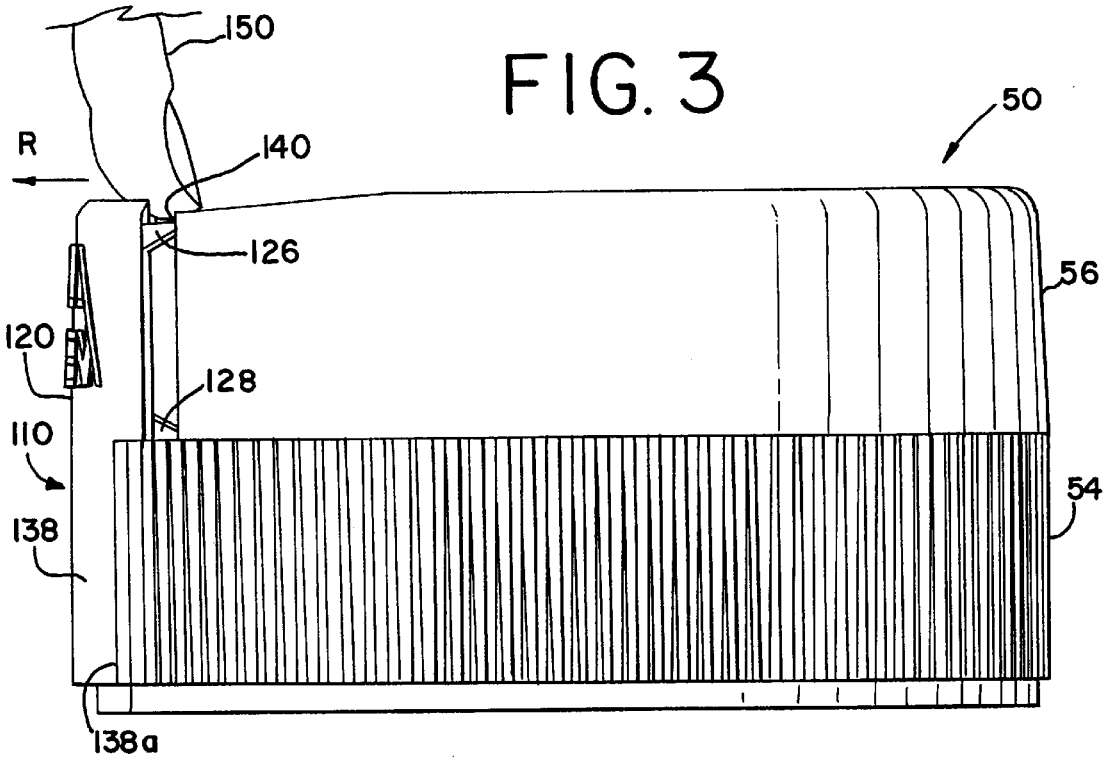
FIG. 3 is a side elevational view of the closure structure shown in FIG. 2 at a first step of opening.

FIG. 3 shows the closure structure 50 in its fully closed position with the lid 56 closed to the body 54. In FIG. 3, the body frangible part 80 is hidden from view by the lid frangible part 110. A finger 150 of a user is interfit partially into the opening 140 in a first step to pry off the frangible parts 80, 110 from the lid 56 and body 54, in the direction R. The apron 138 can be used as a fulcrum against the body 54 to pry off the frangible parts 80, 110. In this regard, a lower edge or region 138*a* of the apron can pivot against the body sidewall to provide a lever advantage.

FIG. 4 illustrates the closure structure 50 wherein the frangible webs 126, 128, 130, 132 (frangible web 132 shown in FIGS. 1, 8 and 9) have been broken from the front wall 100 and the lid frangible part 110 and the body frangible part 80 (held within the lid frangible part 110 and not visible in FIG. 4) are displaced from the body 54 and the lid 56. The curved front wall 100 with the front region 88 of the body 54 provides a finger area for lifting the lid 56 from the body 54. In this regard, an overhang portion or lifting lip 156 extends radially from the lid front wall 100 for providing a prying surface for the user's finger.

Figure 5:
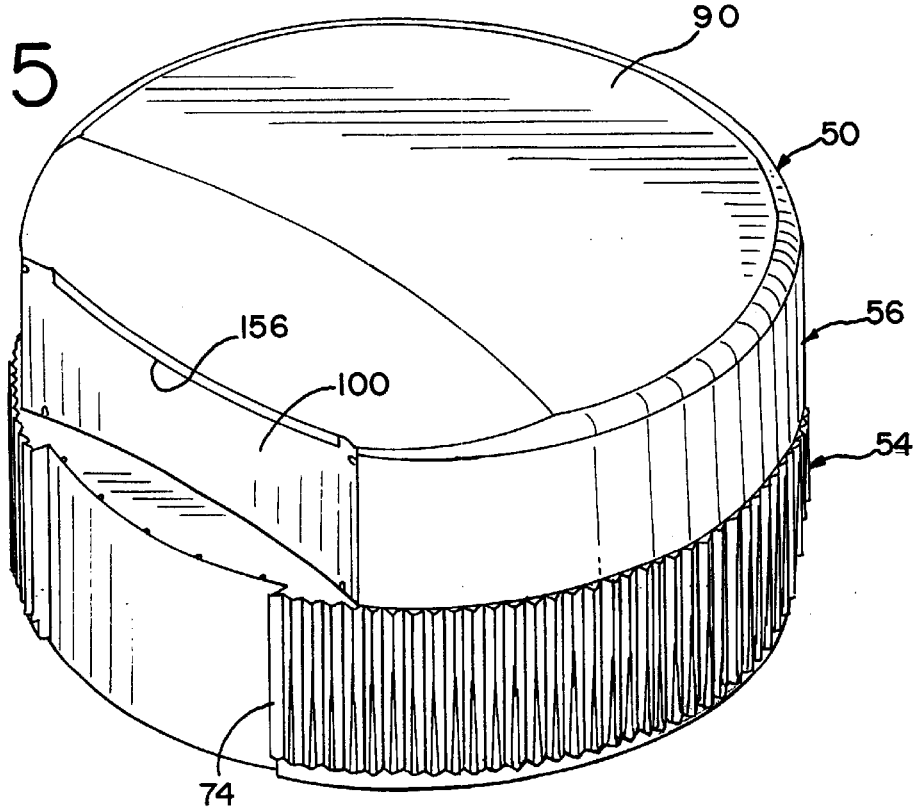
FIG. 5 is a perspective view of the closure structure shown in FIG. 4, with the broken away tamper-evident feature removed.

FIG. 5 illustrates the closure structure 50 with the frangible parts 80, 110 completely removed. The frangible parts 80, 110, which are engaged in a snap-fit relationship described in detail hereinafter, can be discarded as a unit, reducing scrap pieces associated with the closure.

Figure 6:
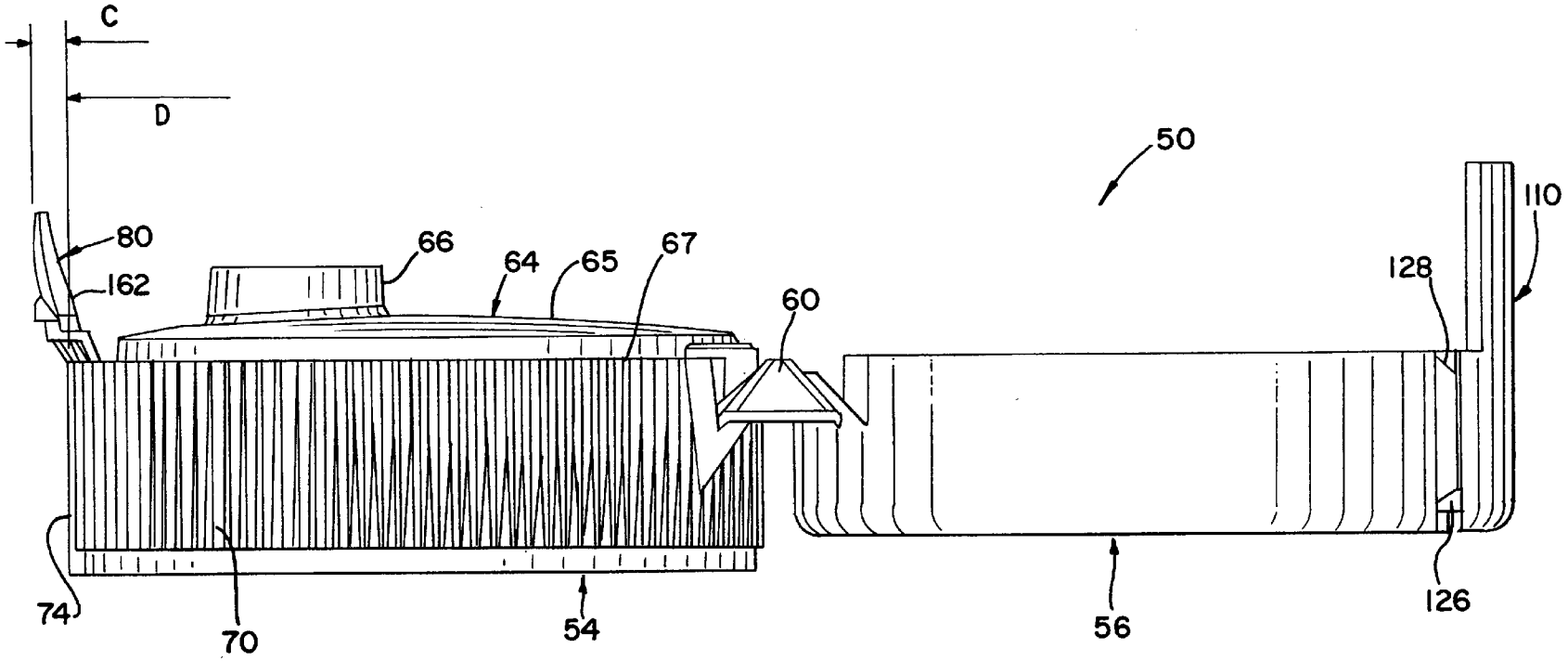
FIG. 6 is a side elevational view of the closure structure shown in FIG. 1.

FIG. 6 illustrates the closure structure 50 in a fully open, as-molded condition. The hinge 60 is preferably a snap action hinge. Such a hinge is disclosed in the U.S. Pat. No. 5,642,824, the disclosure of which is incorporated herein by reference thereto. In an alternate embodiment, the lid 56 need not be connected with a snap-action hinge. A floppy hinge may be used instead.

The body frangible part 80 preferably has a radial extent C located substantially outside of a body outside diameter D for the purpose of molding the closure structure in a simple mold, with a single parting plane, without side pulls. During the ejection phase of the molding cycle, the body frangible part is pivoted inwardly to a near vertical orientation as a result of an undercut condition on the frangible part. As the undercut is pulled, the frangible part is moved inward, pre-positioning it for assembly with the lid frangible part 110.

Figure 7:
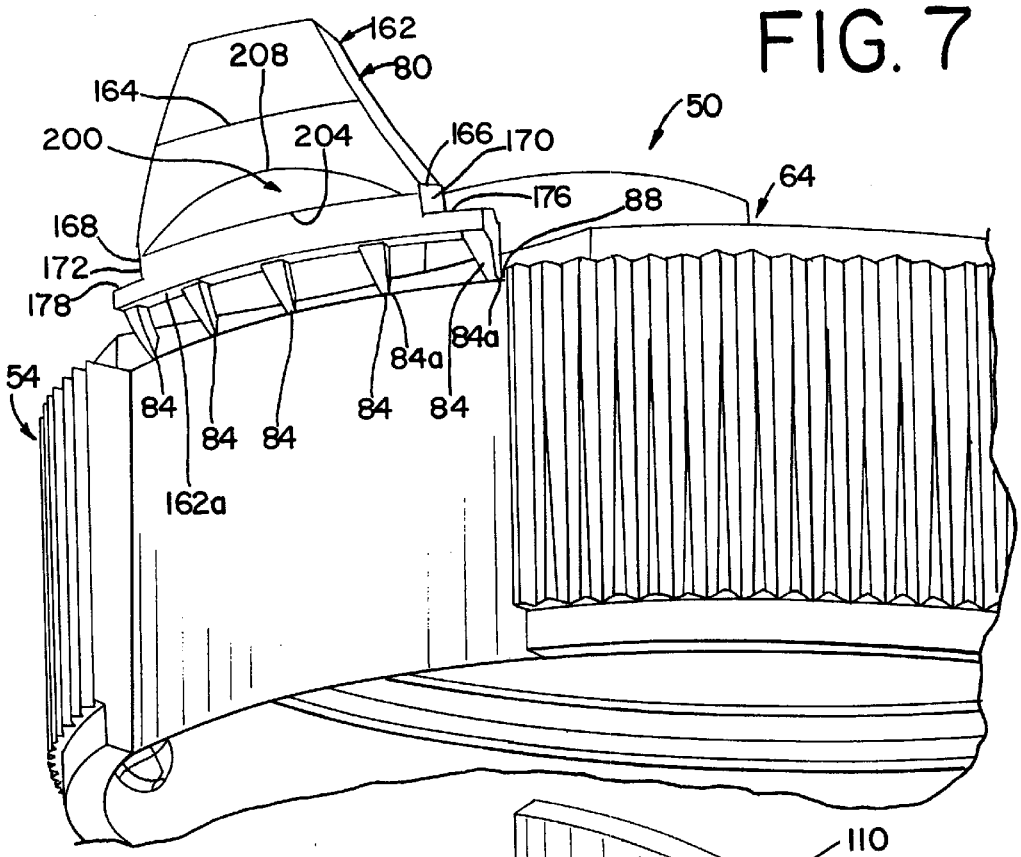
FIG. 7 is an enlarged, fragmentary, perspective view of the closure body of the closure structure of FIG. 1.

FIG. 7 illustrates the body 54 in more detail. The body frangible part 80 includes an upwardly protruding member such as a tapered tongue 162 having a slight rearward radial inflection 164 in a rising direction, on a front side of the tongue 162. The tongue includes downward tangential inflections 166, 168 on opposite lateral sides thereof. The inflections 166, 168 border vertical, straight walls 170, 172 respectively. The straight walls 170, 172 are perpendicular to lateral locking steps 176, 178, respectively, the function of which will be described hereinafter.

The tongue 162 is connected to the front region 88 of the shoulder 67 by the plurality of frangible webs 84. The frangible webs are substantially tapered in a downward direction to create breaking points 84*a* at the intersection with the shoulder 67. Intermediate the inflection 164 and the webs 84 is a first locking element 200 having a crescent shape and extending forwardly, forming a first locking ledge 204 (FIGS. 7–10). The first locking element 200 is tapered in side profile in a rising direction from the ledge 204 to blend or merge into the adjacent surface of the tongue 162 at an arcuate merge line 208.

Figure 8:
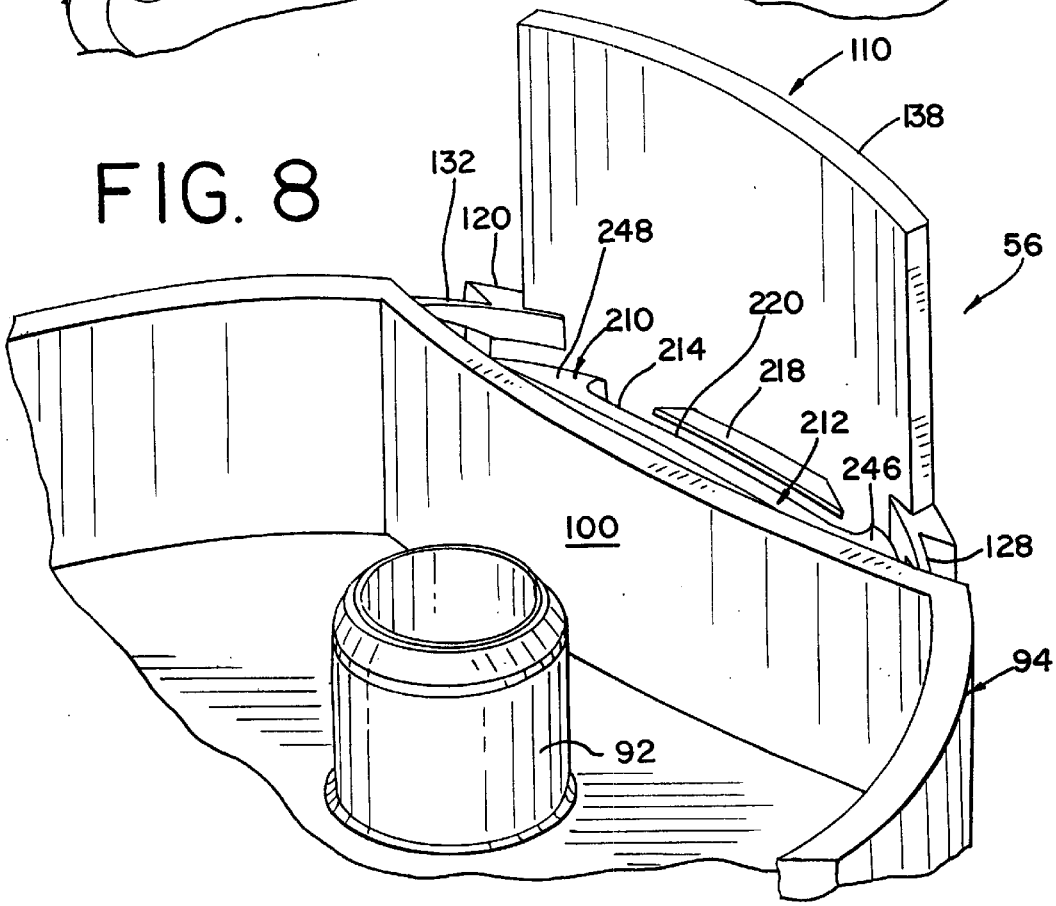
FIG. 8 is an enlarged, perspective view of the closure lid of the closure structure shown in FIG. 1.
Figure 9:
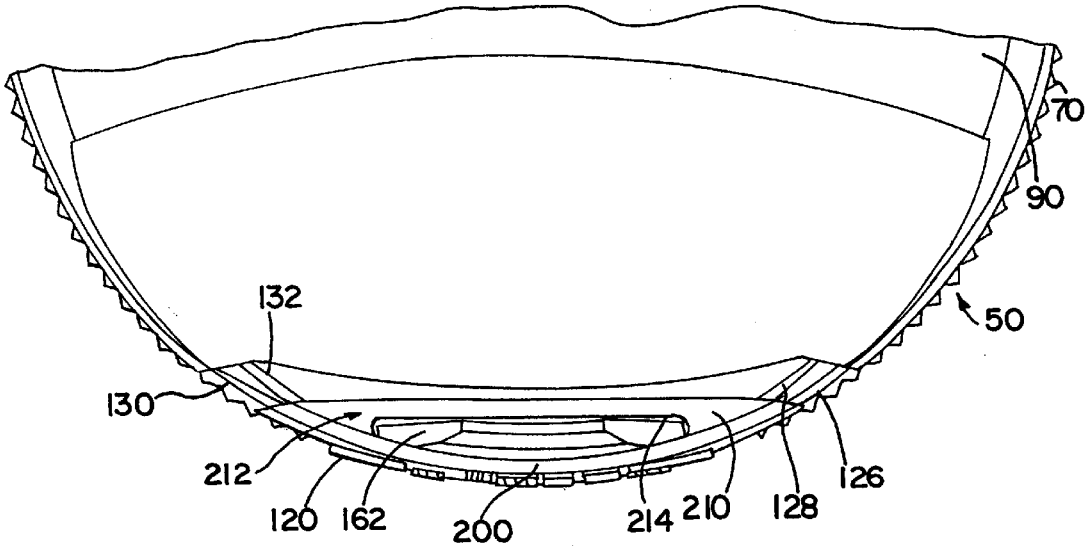
FIG. 9 is an enlarged, fragmentary, plan view of the closure structure shown in FIG. 2.

FIGS. 8 and 9 illustrate the lid 56 in an as-molded orientation, as shown in FIG. 1. The tab portion 120 extends laterally outwardly beyond both sides of the apron 138. A vertical channel portion 210 extends radially inwardly from the tab portion 120 and is elongated in an axial direction. The vertical channel portion 210 and the tab portion 120 together define a socket 212 having a vertically elongated receiver cavity 214 for receipt of the tongue 162 of the body frangible part 80. A second locking element 218 extends rearwardly from the tab portion 120. The second locking element 218 includes a second locking ledge 220 which confronts the first locking ledge 204 of the first locking element 200 of the tongue 162, when the lid 56 is initially closed to the body 54 as shown in FIG. 11.

Figure 11:
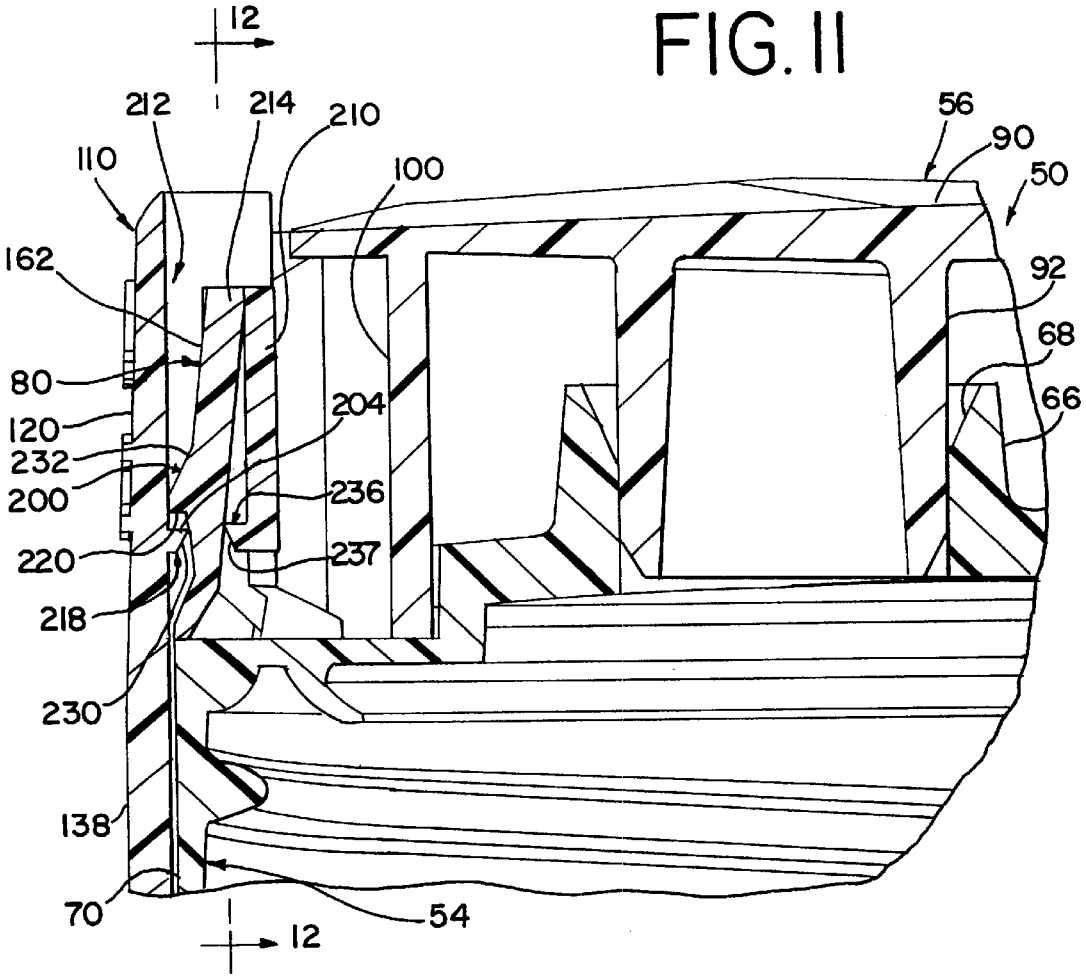
FIG. 11 is a fragmentary, sectional view of the closure structure shown in FIG. 2, the closure structure being in a closed condition.

FIG. 11 illustrates the body frangible part 80 and the lid frangible part 110 as the lid 56 is being closed to the body 54. The second locking element 218 of the lid frangible part 110 includes an inclined rearwardly facing surface 230. The first locking element 200 of the body frangible part 80 includes an inclined forwardly facing surface 232. During initial closing of the lid and body, the inclined surfaces 230, 232 slide over each other, with resilient radial deformation of the two frangible parts 80, 110, until the locking elements 200, 218 override and pass by each other so that the first locking ledge 204 lies in registry with, and confronts, the second locking ledge 220. As shown in FIGS. 10 and 11, the apron 138 slides along the inset 74 to also guide the tongue 162 into the receiver cavity 214.

A backing element 236 can be arranged within the cavity 214 extending forwardly from the channel portion 210 at a position opposite the second locking ledge 218. The backing element 236 includes an inclined surface 237 which assists in centering or guiding the tongue 162 downwardly into the cavity 214. The backing element 236 thereafter prevents radial displacement of the tongue 162 in a manner which would disengage the locking ledges 204, 220. In the fully closed condition shown in FIG. 11, the body frangible part 80 is locked to the frangible lid part 110, and the lid 56 is locked to the body 54.

Figure 12:
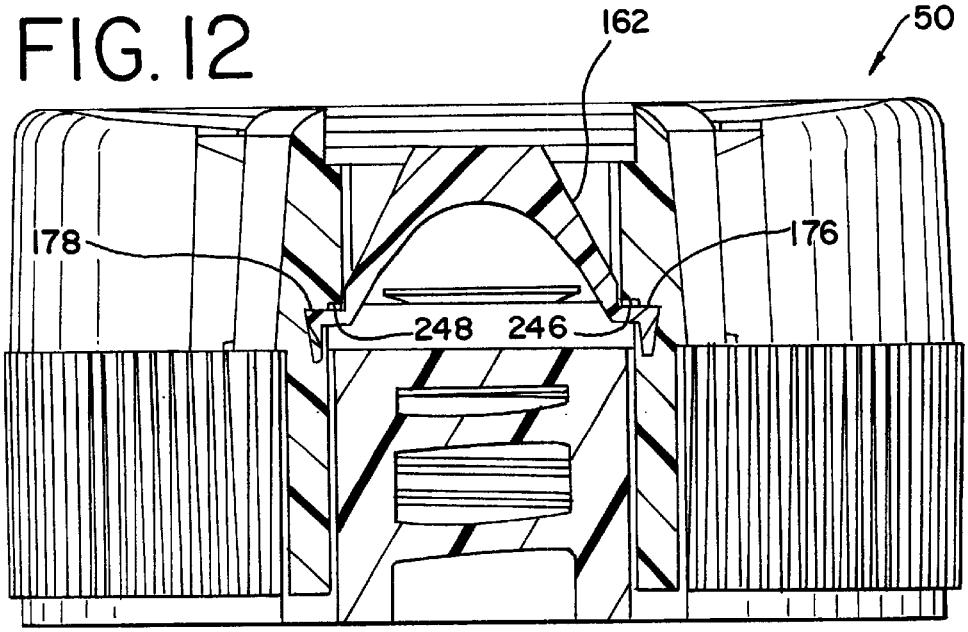
FIG. 12 is a sectional view taken generally along line 12—12 of FIG. 11.

FIGS. 10 and 12 illustrate another feature of the closure structure. The lid frangible part 110 includes abutment surfaces 246, 248 (also shown in FIG. 8). The body frangible part locking steps 176, 178 abut the abutment surfaces 246, 248 of the lid frangible part 110 when the frangible parts 80, 110 are locked together. The abutment surfaces 246, 248 are inset to provide space for the locking steps 176, 178. After removal of the frangible parts 80, 110 from the lid and body, the body frangible part 80 cannot be removed from the lid frangible part 110 in a vertical direction (FIG. 12 orientation) due to the interference between the locking steps 176, 178 and the abutment surfaces 246, 248. Thus, once the locking ledges 204, 220 are in a confronting relationship, the frangible parts 80, 110 are permanently engaged.

In the exemplary embodiment, the apron 138 serves at least four functions: 1) it fills the body inset to maintain cosmetic continuity, 2) it guides the integral body tongue 162 into the receiver cavity 214 during the closing operation, 3) it provides a lever arm (fulcrum) about which the frangible tamper-evident assembly of lid frangible part 110 and body frangible part 80 rotate during removal, and 4) it provides stability and support to the tamper-evident assembly making it less susceptible to breakage due to unintentional outside forces.

The embodiment described above includes a body tongue 162 at a given angle of about 90° to the deck 64, however, it can be located at any orientation, horizontal, vertical or at an oblique angle and pivoted into an engagement position.

The structure shown in FIG. 11 could be further modified by eliminating the lid locking ledge 204 and moving the body locking ledge 220. In particular, the height of the body tongue 162 could be increased above the top of the lid channel portion wall 210. On the upper part of the increased height tongue 162, a ledge could extend rearwardly over the top of the lid channel portion wall 210 so as to provide an abutment that would function analogously to the abutment of the body ledge 220 and lid ledge 204.

Figure 13:
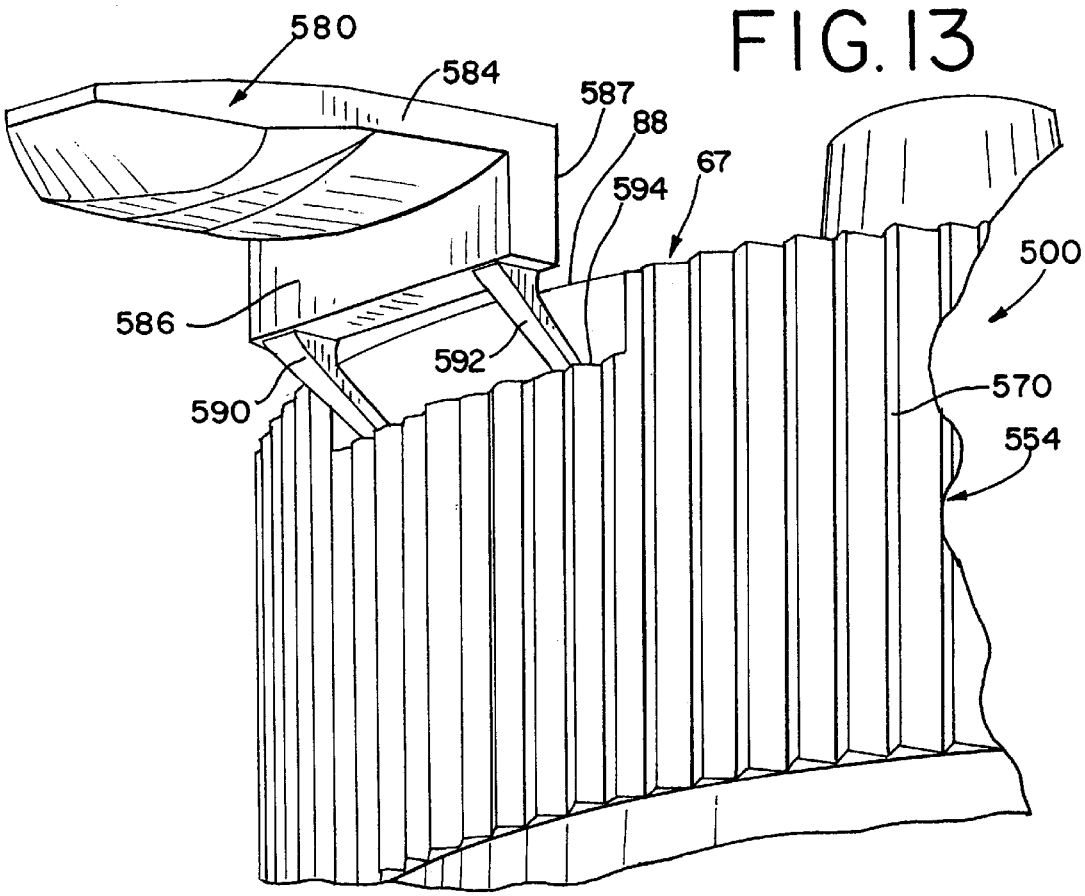
FIG. 13 is a fragmentary, perspective view of an alternate embodiment closure structure having a modified closure body of the invention.

FIG. 13 illustrates an alternate embodiment closure structure 500 including a modified closure body 554 hingedly attached to the lid 56 (as shown in FIG. 1) as previously described. The body 554 includes a modified body frangible part 580. The modified body frangible part 580 includes a modified tongue 584 having a substantially L-shaped side profile with a bottom leg or base plate 586 connected by first and second frangible webs 590, 592 to a recessed region 594. The recessed region 594 is recessed below the annular shoulder 67 and inwardly of adjacent portions of a body annular sidewall 570 of the body. The body frangible part 580 is oriented radially in the as-molded, open condition. The part 580 must be pivoted about 90 degrees to be engageable to the lid frangible part 110.

The latching features of the tongue 584 are identical to those described for the tongue 162, except that the base plate 586 serves the function of the locking steps 176, 178. That is, the base plate 586 abuts a lower portion of the socket 212 such as the abutment surfaces 246, 248 (FIG. 12), or a similar recessed downwardly facing surface, to retain the body frangible part 580 engaged with the lid frangible part 110, after the frangible parts 110, 580 are removed from the body and lid. The body 554 is illustrated without an inset 74, so that a corresponding apron 138 would either not be provided or if provided, would fit over the body sidewall. Alternatively, the apron 138 and the inset 74 could be provided in identical fashion as in the previously described first embodiment illustrated in FIGS. 1–12.

In the orientation shown in FIG. 13, the closure body 554 can be more easily molded without using any side pull action. Just prior to the initial pivoting of the as-molded lid 56 to the closed position on the closure body 554, the tongue 584 is pivoted clockwise 90 degrees such that a bottom rectangular surface 587 of the base plate 586 rests on the annular shoulder 67, particularly the wide front region 88 thereof. This provides a firm load support of the tongue 584 during the vertical pressing together of the frangible parts 110, 580.

Figure 14:
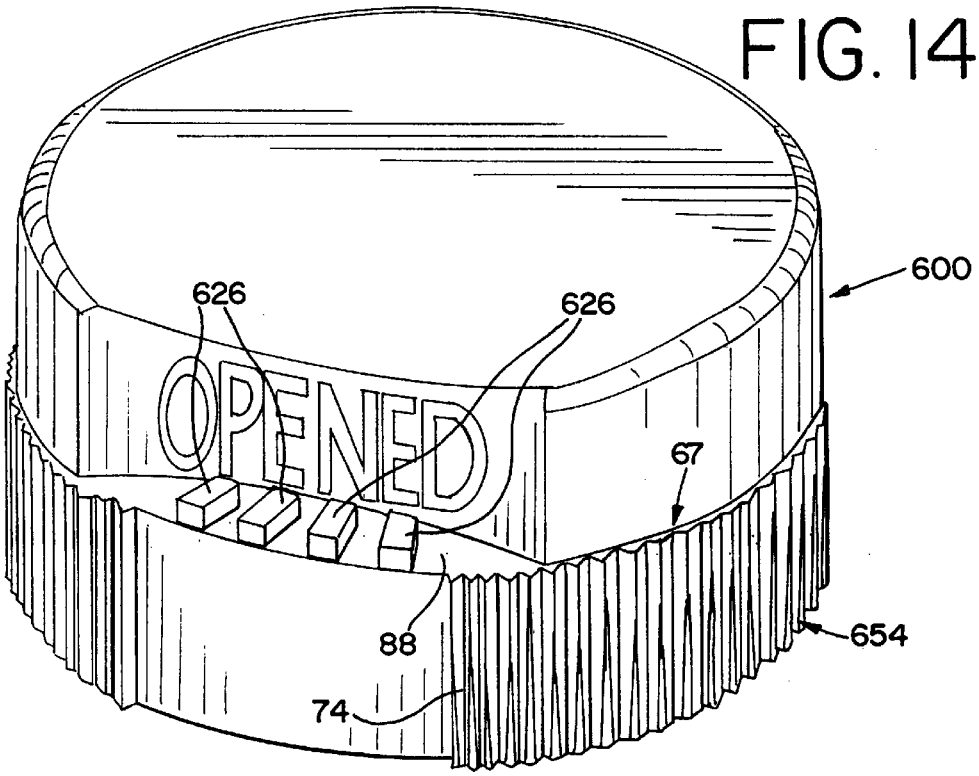
FIG. 14 is a perspective view of a further alternate embodiment closure structure with the tamper-evident feature removed.

FIG. 14 illustrates a further alternate embodiment closure structure 600 in a closed condition, after the frangible parts 110, 80 or 580 (as embodied in FIGS. 1–13), have been removed. In an alternate embodiment employing the tongue shown in FIG. 13, the body 654 includes load bearing protrusions 626 arranged on the front, wide region 88 of the annular shoulder 67 (as previously described). The load bearing protrusions act together as a support plane for the base plate 586 of the tongue 580 (as shown in FIG. 13). The frangible webs 590, 592 of FIG. 13 would be attached to the shoulder 67 on opposite ends of the row of protrusions 626. The protrusions stiffen the deck in the vicinity of tongue 584 to withstand the latching force of the lid to the body.

Alternatively, the body frangible part 80 from the first embodiment (FIGS. 1–12) could be used with the closure structure of FIG. 14, with a bottom surface 162*a* (FIG. 7) of the tongue 162 being supported between the webs 84 by the protrusions 626, i.e., the webs 84 and the protrusions 626 being enmeshed. The tongue 162 is thus configured such that the bottom surface 162*a* of the tongue rests directly on the top of the body, thereby absorbing the entire force of the latching process, while the frangible webs 84 remain as substantially non-load bearing features. The previously described inset 74 for the apron 138 (not shown) is provided in this illustrated embodiment.

In the preferred embodiments, the integral lid frangible part 110 has the same outside dimension as the closure structure body so as to be flush with the closure structure, that is, not being protruding or inset. However, the design is not restricted to only this configuration.

The embodiments discussed above portray attachment of the body tab to the body via individual frangible webs. However, a frangible continuous or discontinuous film, made frangible by having a reduced thickness, or by perforating or intermittent through-cuts, may also be used.

It will be readily apparent from the foregoing detailed description of the invention and from the illustrations thereof that numerous variations and modifications may be effected without departing from the true spirit and scope of the novel concepts or principles of this invention. For example, although the closure assembly of the invention is exemplified by a threaded engagement with the container, the invention contemplates other fastening techniques and implements for securing the closure assembly to the container. Other fastening might incorporate a friction fit facilitated by a closure assembly having a skirt with an inside diameter sized to provide a sliding or telescoping engagement with a smooth, threadless container finish. In such an embodiment, the fitment and closure body would be provided with abutment surfaces, for example, a bayonet type interlock or fastening implement, which permit installation of the closure assembly on the container, but which may be configured, for example, by relative rotation of the closure body and container, to restrict upward movement of the closure body relative to the container.

What is claimed is:

1. A closure structure, comprising:

a closure body having a deck and a depending sidewall, said deck having a dispensing opening therethrough;

a lid hingedly attached to said body and having a lid portion aligned with said dispensing opening such that closing of said lid to said body covers said dispensing opening with said lid portion; and said closure body having a protruding member extending above said deck, said protruding member having a first locking element, and said lid having a socket, said socket having a receiver cavity and a second locking element located inside said receiver cavity, said receiver cavity aligned with said protruding member such that upon closing of said lid to said body said protruding member enters said receiver cavity and said first and second locking elements engage to lock said protruding member to said socket, said protruding member and said socket connected to said body and said lid respectively by frangible connections.

2. The closure structure according to claim 1, wherein said protruding member comprises a vertically tapered profile.

3. The closure structure according to claim 1, wherein said protruding member has a base end, and said protruding member comprises a locking step at said base end and said socket comprises a corresponding abutment surface, said abutment surface abutting said locking step when said protruding member is locked to said socket, thereby preventing said protruding member from being disengaged from said socket after said protruding member and said socket are removed together from said body and lid.

4. The closure structure according to claim 1, wherein said lid includes a front vertical surface and said lid comprises a front recess on said front vertical surface and said socket is disposed at least partially within said front recess.

5. The closure structure according to claim 4, wherein said lid includes a lifting lip extending into said front recess for lifting the lid after said socket has been removed.

6. The closure structure according to claim 1, wherein said socket includes a apron that extends below said protruding member when said lid is engaged to said body, and said sidewall of said body includes a front inset for receiving said apron to be flush with an outside of said sidewall.

7. The closure structure according to claim 1, wherein said lid has a periphery having a major portion that is substantially circular, and said lid comprises an end wall and a depending skirt, said skirt comprising a partially annular portion closed by a substantially transverse wall, said transverse wall defining a front recess in said substantially circular periphery, said socket arranged in said recess, outside of said skirt.

8. The closure structure according to claim 7, wherein said frangible connections between said socket and said lid comprise breakable webs.

9. The closure structure according to claim 1, wherein said socket comprises a backing element arranged inside said receiver cavity, in registry with said second locking element.

10. The closure structure according to claim 9, wherein said second locking element and said backing element comprise top surfaces declined in a radially inward direction to center said protruding member in said receiver cavity during insertion.

11. The closure structure according to claim 1, wherein said breakable connection between said protruding member and said body comprises a plurality of breakable webs.

12. The closure structure according to claim 1, wherein said first locking element on said protruding element comprises a first ledge formed on a front surface of said protruding element extending forwardly, and said second locking element of said receiver cavity comprises a second ledge formed on a rearwardly facing inside surface of said socket and extends rearwardly.

13. The closure structure according to claim 1, wherein said first locking element of said protruding member comprises a first inclined surface, and wherein said second locking element of said receiver cavity comprises a second inclined surface, said first and second inclined surfaces being in facing relationship during engagement of said socket onto said protruding member, and said first inclined surface sliding on said second inclined surface during insertion of said protruding member into said socket so as to resiliently open up said receiver cavity and compress said first and second locking elements to allow said first and second locking elements to override and pass by each other and snap to an engagement position.

14. The closure structure according to claim 1, wherein said protruding member is connected to said body via flexible frangible webs, said protruding member having an as-molded posture extending radially from said body and being bendable to an upright, axially elongated orientation to be insertable into said socket during closing of said lid to said body.

15. The closure structure according to claim 14, wherein said protruding member comprises a bottom surface, said bottom surface being arranged to be supported on said closure body, force from the vertical latching of said socket onto said protruding member being transferred into said body from said bottom surface.

16. The closure structure according to claim 15, wherein said closure body provides a plurality of spaced protrusions which underlie said bottom surface of said protruding member to transfer vertical force through said protruding member into said body.

17. The closure structure according to claim 1, wherein said closure body comprises internal threads for attaching said body to a threaded neck of a container.

18. The closure structure according to claim 1, wherein said closure body is formed as a unitary part of a container body.

19. The closure structure according to claim 1, wherein said closure body comprises a means for attaching said closure body to a container.

20. The closure structure according to claim 1, wherein said protruding member comprises a bottom surface, said bottom surface being arranged to be supported on said closure body so that force from the vertical latching of said socket onto said protruding member is transferred into said body from said bottom surface.

21. A dispensing closure, comprising:

a closure body having (1) a deck having a deck surface and a depending skirt adapted to be mounted on a container neck, (2) a dispensing orifice formed through said deck, and (3) a protruding member extending from said deck surface, said protruding member including a first locking ledge at an intermediate position along a length of said protruding member; and a lid hinged at one side to said closure body at a position opposite to said protruding member, said lid having a socket on a side of said lid opposite said hinge, said socket having a receiver cavity open in an axial direction of said lid and including a second locking ledge extending radially within said receiver cavity, said first and second locking ledges engageable when said protruding member is positioned sufficiently within said receiver cavity when said lid is initially closed to said body, said engagement of said first and second locking ledges preventing said lid from being opened from said body, said socket and said protruding member being connected to said lid and said body respectively by frangible elements.

22. The closure structure according to claim 21, wherein said body includes an inset on a surface thereof below said protruding member, and said lid includes an apron extending from said socket, said apron and said inset being shaped and configured such that said apron fits within said inset to be flush with adjoining surfaces of said skirt of said body when said lid is engaged to said body.

23. The closure according to claim 21, wherein said lid includes a front recess opposite said hinge, and said socket is disposed within said recess, said socket having a rounded outside surface which is contoured to be flush with adjoining surfaces of said lid.

24. The closure according to claim 23, wherein said front recess of said lid is formed by an axially elongated curved wall.

25. The closure according to claim 21, wherein said lid further comprises an apron extending from said socket below said protruding member and against said body skirt.

26. The closure structure according to claim 21, wherein said protruding member comprises a locking step at a base end thereof, and said socket comprises a corresponding abutment surface, said abutment surface abutting said locking step when said protruding member is locked to said socket to thereby prevent said protruding member from being disengaged from said socket after said protruding member and said socket are removed together from said body and lid.

* * * * *